US009327377B2

(12) United States Patent
Keller-Sornig et al.

(10) Patent No.: US 9,327,377 B2
(45) Date of Patent: May 3, 2016

(54) MACHINE TOOL, IN PARTICULAR HAND-HELD MACHINE TOOL

(75) Inventors: Peter Keller-Sornig, Auenstein (CH); Georg Hejtmann, Mundelsheim (DE); Aldo Di Nicolantonio, Recherswil (CH); Stefano Delfini, Bettlach (CH); Ralf Materna, Greifensee (CH); Adrian Schoch, Warth (CH); Dieter Troendle, Neuhausen (CH)

(73) Assignee: Robert Bosch GmbH, Stuttgart (DE)

( * ) Notice: Subject to any disclaimer, the term of this patent is extended or adjusted under 35 U.S.C. 154(b) by 197 days.

(21) Appl. No.: 13/819,744

(22) PCT Filed: Aug. 29, 2011

(86) PCT No.: PCT/EP2011/064788

§ 371 (c)(1),
(2), (4) Date: Jun. 11, 2013

(87) PCT Pub. No.: WO2012/028564

PCT Pub. Date: Mar. 8, 2012

(65) Prior Publication Data

US 2013/0331011 A1 Dec. 12, 2013

(30) Foreign Application Priority Data

Sep. 2, 2010 (DE) ..... 10 2010 040 140

(51) Int. Cl.

| | |
|---|---|
| ***B24B 1/04*** | (2006.01) |
| ***B24B 21/22*** | (2006.01) |
| ***B24B 23/06*** | (2006.01) |

(52) U.S. Cl.
CPC . *B24B 1/04* (2013.01); *B24B 21/22* (2013.01); *B24B 23/06* (2013.01)

(58) Field of Classification Search
CPC ..... B24B 1/04; B24B 21/22; B24B 23/06
USPC ..... 451/163, 164, 168, 296, 304, 355, 444
See application file for complete search history.

(56) References Cited

U.S. PATENT DOCUMENTS 3,273,288 A * 9/1966 Kuris et al. ..... 451/178

(Continued)

FOREIGN PATENT DOCUMENTS

| | | | |
|---|---|---|---|
| DE | 44 30 152 | A1 | 2/1996 |
| DE | 100 41 925 | A1 | 3/2002 |
| DE | 101 25 483 | A1 | 11/2002 |
| DE | 10 2004 061 222 | B3 | 7/2006 |

(Continued)

OTHER PUBLICATIONS

International Search Report corresponding to PCT Application No. PCT/EP2011/064788, mailed Dec. 16, 2011 (German and English language document) (5 pages).

*Primary Examiner* — Robert Rose
(74) *Attorney, Agent, or Firm* — Maginot, Moore & Beck LLP

(57) ABSTRACT

A machine tool, for example a hand-held belt grinder, is subjected to high frequencies outside a working plane between an abrasive belt and a workpiece. In particular, the machine tool is subject to high frequencies in a free-running region of the belt, of an excitation actuator, in particular by a piezo element.

17 Claims, 1 Drawing Sheet

(56) References Cited

U.S. PATENT DOCUMENTS

| | | | | |
|---|---|---|---|---|
| 3,430,390 | A * | 3/1969 | Wolcott et al. | 451/164 |
| 3,517,460 | A * | 6/1970 | Kane et al. | 451/8 |
| 5,643,062 | A * | 7/1997 | Joseph et al. | 451/355 |
| 6,392,329 | B1 | 5/2002 | Bryant et al. | |
| 2002/0177393 | A1* | 11/2002 | Lang et al. | 451/355 |

FOREIGN PATENT DOCUMENTS

| | | | |
|---|---|---|---|
| JP | 9-267241 | A | 10/1997 |
| JP | 2002-301643 | A | 10/2002 |
| JP | 2002-346905 | A | 12/2002 |
| JP | 2003-94327 | A | 4/2003 |
| SU | (11) 1404307 | A1 * | 3/1986 |

* cited by examiner

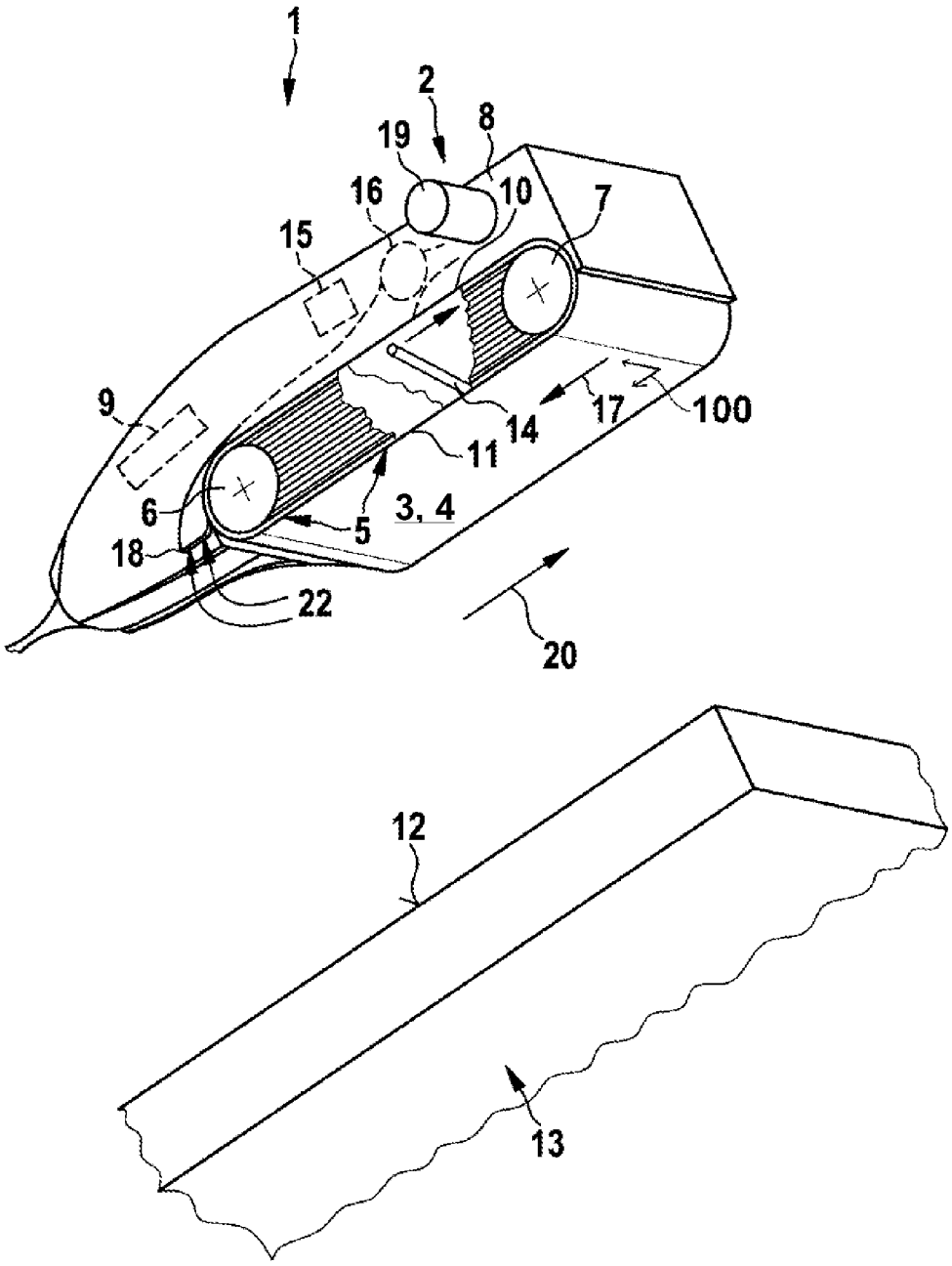
1
2
19
8
16
10
7
15
9
14
17
100
11
6
5
3, 4
18
22
20
12
13

MACHINE TOOL, IN PARTICULAR HAND-HELD MACHINE TOOL

This application is a 35 U.S.C. §371 National Stage Application of PCT/EP2011/064788, filed on Aug. 29, 2011, which claims the benefit of priority to Serial No. DE 10 2010 040 140.4, filed on Sep. 2, 2010 in Germany, the disclosures of which are incorporated herein by reference in their entirety.

The disclosure relates to a power tool, in particular a hand power tool, according to the description below.

BACKGROUND

Sanding machines of the aforementioned type, designed as a hand power tool, are known from DE 10 2004 061 222 B3. In the case of these machines, a carrying plate, by means of which a working position for the working means is defined, is provided as a carrying arrangement for the working means, and the working means is movable in a driven manner, in the case of a working plane parallel to the surface of a workpiece that is to be worked. Superimposed on this, the working means is impinged upon at high frequency by means of an excitation actuator, which operates on an ultrasonic basis and impinges upon the working means via a gel mass located between the latter and the carrying plate. The excitation of oscillations by means of the excitation actuator is effected vertically or horizontally in relation to the working plane, with the purpose of refining the surface, sanding machines having an oscillating or rotating drive of the carrying arrangement, and also belt sanders, being provided as power tools realized in such a manner.

In the case of sanding devices having a revolving sanding means, in particular a sanding belt, and having a workpiece carrier, in the form of a revolving transport belt, for the purpose of fixing the respective workpiece to be worked, DE 100 41 925 A1 discloses that the sanding belt is impinged upon in the region thereof that faces toward the transport belt, runs parallelwise in relation to the transport belt and is supported against the workpiece that is carried by the transport belt and located between the transport and sanding belt, by means of a pressing element, in the direction of the workpiece and the transport belt located beneath it. Superimposed on the codirectional motion of the transport belt and sanding belt, the latter are put into an oscillating motion, relative to each other, that differs from the direction of advance. The forces that, in respect of a particular point on the surface of the workpiece, act from differing directions, determined by the advance motions and oscillating motions, enable a high removal rate, and are also intended to ensure the latter, in particular through reduction of the adhesive wear mechanisms occurring in dependence on temperature in the working region.

SUMMARY

The disclosure is based on the object of utilizing the impingement upon the working means, effected at high frequency, to prolong the service life of the working means that can be used with good working results.

This object is achieved, according to the disclosure, through the features of claim 1 described below, and expedient developments are given by the description below.

In the case of the solution according to the disclosure, the manner in which the working means acts upon the particular workpiece surface to be worked is not influenced directly on the basis of the oscillating, in particular high-frequency, excitation of the working means, but, rather, the working means is excited correspondingly, in particular impinged upon at high frequency, outside of the contact region between the working means and the workpiece, thus, in particular, in a region offset in relation to the working plane. This is effected in such a way that the working structure of the working means is freed of any accretions or adhering deposits, thus, for example, is not impaired by adhering deposits and/or dirt.

Thus, in the case of a working means constituted by, for example, a polishing belt, a sanding belt, a flat sanding paper or the like, deposited dirt or dust can be shaken off and, possibly, can also be directly extracted by suction, such that the working means is deployed in a cleaned state in its respective working region. In a corresponding manner, for example in the case of a working means realized as a sanding belt or as a flat sanding paper, accretions that impair the sanding structure and that possibly also partially cover the latter, as a result of smears or the like, can be ejected as a result of the impinging at high frequency, such that, although a normal wear of the working structure does occur, conditional upon service life, the structure nevertheless remains fully usable in its respective state of maintenance, i.e. is not covered by deposits, smears or the like and is no longer usable.

In particular, the oscillating impingement upon the working means is effected, by means of the respective excitation actuator, preferably on the back side of the working means that is away from the working side, and this, in turn, preferably being effected orthogonally in relation to the direction of extent of the working means.

In respect of a working means realized as a revolving sanding belt or polishing belt, a preferred solution in respect thereof is to impinge upon the working means in a region offset from its strand that extends along the working plane, in particular the region of the returning strand, extending freely between the directional turns, constituting a preferred region of application for one or more excitation actuators that directly or indirectly act upon the belt, possibly in each case via one or more impact strips, as transmission members.

If at least one excitation actuator is provided as an excitation element for a plurality of impact strips, which extend, as individual strips, preferably transversely in relation to the direction of revolution of the working means, it can be expedient for these strips to be provided such that they are spaced apart in the direction of revolution, and possibly also angled in relation to each other, in order to achieve wave-shaped excitation patterns, which promote ejective cleaning of the respective deposits.

In particular, piezo elements are possible as excitation actuators within the scope of the disclosure, although, according to the disclosure, excitation can also be effected on a magneto-resistive basis, operating frequencies in the range from 15 kHz to 1 MHz, but typically from 20 kHz to 60 KHz being used, this being in the case of an excitation actuator power that, for this application purpose, is preferably in the order of magnitude of 20 W or above.

The power density for ultrasonic actuators provided for the purpose according to the disclosure is 5 or more W/cm3 of piezo volume, typically more than 20 W/cm3 of piezo volume, an active piezo volume of >0.2 cm3, preferably >1 cm3, being provided. Expediently, moreover, a phase regulating chain is provided for precise excitation in the resonant frequency for maximum power yield, the excitation being effected, if possible, with the phase shift 0° of current and voltage.

Constructed on this basis, an easily manipulated hand tool can be configured, in particular as a sanding or polishing tool, with not only the excitation actuator, in particular in the form of an ultrasonic generator, but also the control electronics and the power supply being disposed such that they are integrated in the machine housing and, instead of or in addition to a possible mains power supply, it being possible also to effect a power supply by means of a battery pack, in particular an attachable battery pack.

It is also within the scope of the disclosure for the working means, in particular in the form of a sanding or polishing belt, to be excited in an oscillatory manner on a magnetic or inductive basis. In particular in combination with such forms of oscillating excitation and/or impingement upon the working means, thus, for example, of the sanding or polishing belt, it proves expedient for the latter to be realized with metallic inclusions, inserts, in particular in the form of thread or fabric, or also sanding or polishing belt based on a metallic carrier.

BRIEF DESCRIPTION OF THE DRAWINGS

Further details and features of the disclosure are given by the description of the figures and by the drawing, which shows, largely in schematic form, a hand power tool, realized as a belt sander, in a perspective, schematic representation, obliquely underneath from the rear, with a workpiece located beneath it.

DETAILED DESCRIPTION

Shown in the FIGURE, as an example of an electric power tool according to the disclosure, is a hand power tool 1 in the form of a hand-guided belt sander 2, which, as working means 3, has a revolving sanding belt 4, which is supported in relation to the machine housing 8 by means of a carrying arrangement 5 having turnaround rollers 6 and 7. The machine housing 8 accommodates the drive for the sanding belt 4, a corresponding drive motor 9 being indicated schematically, which drive motor is connected in a driving manner to at least one of the turnaround rollers 6, 7 by which the sanding belt 4 is guided. The turnaround rollers 6, 7 are disposed so as to be axially parallel to each other and, between the regions in which the sanding belt 4 is in bearing contact with the turnaround rollers 6, 7, the sanding belt extends with its free strands 10, 11. A strand in this case is understood to mean, in particular, a free portion of the sanding belt 4 that is not in bearing contact.

Of these strands 10, 11, the strand 11, which is the lower strand in the representation and which faces toward the surface 12 of a workpiece 13 that is to be worked, represented schematically in the example, extends in the respective working plane 100, in which it is in bearing contact with the surface 12 to be worked and moves over the latter in a material-removing and/or smoothing manner—in particular, in an abrading, cutting, scraping, sanding, polishing manner—in dependence on the nature of the working means 3. Associated therewith is a greater or lesser degree of abrasion on the part of the surface 12 of the workpiece 13, as well as a certain dulling of the working means. This depends, on the one hand, on the material of the workpiece surface 12 that is to be worked, and, on the other hand, on the nature of the coating of the working means 3, for example with sanding particles, and not least, also, on the length of the strand 11, the turnaround speed and the pressing force between the working means 3 and the surface 12 that is to be worked. In particular, these factors are also determinant of whether and to what extent a respective abrasion by means of the revolving working means 3 is discharged out of the respective working zone, extending in the working plane 100, by the revolving working means, or becomes joined to the working means, in particular in dependence on the material and in dependence on the temperature, and possibly renders the working structure of the working means unusable, whether as a result of dulling, sticking-on or caking.

In order to preclude the latter impairments, in particular, smearing, sticking-on and/or caking, according to the disclosure the working means is impinged upon at high frequency in a region offset in relation to the working plane 100, and consequently in relation to the surface 12 of the workpiece 13, by means of an excitation actuator 15, in particular an ultrasonic oscillator, the upper strand 10, which preferably extends substantially freely between the turnaround rollers 6, 7 and which is offset from the working plane 100, being possible as an impingement region.

The oscillatory impingement provided according to the disclosure is effected on the back side of the upper strand 10, preferably by means of at least one strip-type transmission member 14, which extends transversely in relation to the longitudinal direction of the strand and upon which the excitation actuator 15 impinges directly or indirectly. The latter, as also the transmission member 14, can be disposed in the free space between the upper and the lower strand 10, 11 or, if disposed laterally in relation to the machine housing 8, can be connected to the transmission member 14. Moreover, it is within the scope of the disclosure that the excitation actuator 15 itself acts upon the working means 3 and, for example configured in the manner of a strip, corresponding to the transmission member 14, engages on the back side of the upper strand 10. A particularly efficient beating impingement upon the working means 3 ensues if the transmission member 14, possibly also the excitation actuator 15 acting directly upon the working means 3, is disposed in relation to the working means 3 such that a contacting impingement upon the working means 3 ensues only if the excitation actuator 15 is energized, but otherwise the working means 3 is free in respect of the transmission member 14 or in respect of the excitation actuator 15.

In a corresponding manner, an oscillatory excitation on a magnetic or inductive basis can also be effected, by means of excitation actuators provided for this purpose, within the scope of the disclosure.

Since, according to the disclosure, the carrying arrangement 5 and the working means 3 are accommodated so as to be largely encompassed by the machine housing 8, it is possible, advantageously, for dirt that is separated, in particular ejected, from the working means 3 by means of the excitation actuator 15, directly or indirectly through the interposition of the transmission member 14, to be collected, in particular directly, by means of a suction extraction device assigned to the machine housing 8 or accommodated by the machine housing 8, which suction extraction device can be constructed and configured in the usual manner, and it is also possible to provide a corresponding collecting container that can be removed or separated from the machine housing 8. In the FIGURE, such a suction extraction device is indicated schematically at 16, in the form of a fan, which is preferably operated concomitantly by means of the drive motor 9 of the carrying arrangement 5, and by means of which conduction of air, extending along the upper strand 10, is forced.

It proves expedient in this case if a suction opening 18 is provided at the end of the machine housing 8 at which the working means 3, realized as a sanding belt 4, possibly also as a polishing belt, runs into the machine housing 8 by rising up, out of the working plane 100, via the turnaround roller 6 of the carrying arrangement 5, such that, on the one hand, the abrasion carried along by the working means 3 is sucked away out of the working region and, on the other hand, the suction flow—symbolized by the arrows 22—is routed via the upper strand 10 as far as an outlet opening 19 that is preferably provided, in particular, on the side of the machine housing 8. In this case, in particular, the abraded material can also be collected in the region adjacent to the outlet opening 19, for example in a collecting bag, which is connected to the connector piece that contains the outlet opening 19. A dust collection system, integrated into the housing 8, may possibly also be effected. The direction of revolution 17 for the working means 3 in the region of the lower strand 11 extending substantially in the working plane 100 runs contrary to the working direction 20 for the belt sander 2 represented.

To facilitate manipulation, the belt sander can be provided with handles, provided on the side of the machine housing 3.

The disclosure thus creates a preferably hand-guided, electrically driven belt sander, which, by means of an excitation actuator, in particular a piezo element, is impinged upon at high frequency, directly or indirectly, outside of the working plane 100 that is defined, in relation to the workpiece, by the sanding belt, primarily in order to free the sanding belt of deposits and thereby to keep free the working structure of the sanding belt.

The invention claimed is:

1. A hand-held power tool comprising:

a driven carrying arrangement for a working mechanism;

a working plane for the working mechanism defined by the driven carrying arrangement, wherein a lower strand of the working mechanism extends along the working plane; and an excitation actuator configured to directly impinge upon the working mechanism in a contact manner at high frequency only when the excitation actuator is activated and is otherwise not in contact with the working mechanism, wherein the excitation actuator is configured to impinge upon the working mechanism on an upper strand of the working mechanism offset from the lower strand of the working mechanism that extends along the working plane.

2. The power tool as claimed in claim 1, wherein the working mechanism is in the form of at least one of a belt, a sanding element and a polishing element.

3. The power tool as claimed in claim 1, wherein the excitation actuator is configured to impinge upon a back side of the working mechanism.

4. The power tool as claimed in claim 1, wherein the excitation actuator is configured to impinge upon the working mechanism orthogonally in relation to a direction of extent.

5. The power tool as claimed in claim 1, wherein:

the working mechanism is one of a revolving sanding belt and a polishing belt, and the working mechanism is impinged upon by the excitation actuator at high frequency.

6. The power tool as claimed in claim 5, wherein the working mechanism is impinged upon by the excitation actuator in a region that is located between turnaround rollers of the carrying arrangement.

7. The power tool as claimed in claim 6, wherein the excitation actuator is configured to impinge upon the working mechanism by a strip-type transmission member that lies transversely in relation to a direction of revolution.

8. The power tool as claimed in claim 6, wherein the excitation actuator is an element configured to impinge in the manner of a strip upon the working mechanism.

9. The power tool as claimed in claim 1, wherein the excitation actuator is configured to operate in an ultrasonic range and is a piezo element.

10. The power tool as claimed in claim 1, wherein the excitation actuator is configured to excite the working mechanism in an oscillatory manner on one of a magnetic basis or an inductive basis.

11. The power tool of claim 7, wherein the strip-type transmission member extends across the full width of the upper strand.

12. The power tool of claim 7, wherein the strip-type transmission member includes a plurality of strips.

13. The power tool of claim 7, wherein the strip-type transmission member includes a strip having a rounded cross-section.

14. A hand-held power tool comprising:

a driven carrying arrangement for a working mechanism;

a working plane for the working mechanism defined by the driven carrying arrangement, wherein a lower strand of the working mechanism extends along the working plane; and an excitation actuator configured to indirectly impinge upon the working mechanism in a non-contact manner at high frequency, wherein the excitation actuator is configured to impinge upon the working mechanism on an upper strand of the working mechanism offset from the lower strand of the working mechanism that extends along the working plane.

15. The power tool as claimed in claim 14, wherein:

the working mechanism contains metallic inclusions; and the excitation actuator is a magnetic or inductive actuator operable on the metallic inclusions to oscillate the upper strand of the working mechanism.

16. The power tool of claim 14, wherein the excitation actuator is a strip-type transmission member that lies transversely in relation to a direction of revolution of the working mechanism.

17. The power tool of claim 16, wherein the strip-type transmission member extends across the full width of the upper strand.

* * * * *